US005477576A

United States Patent [19]

Berkcan

[11] Patent Number: 5,477,576

[45] Date of Patent: Dec. 26, 1995

[54] TEMPERATURE COMPENSATION METHOD FOR A TURBIDITY SENSOR USED IN AN APPLIANCE FOR WASHING ARTICLES

[75] Inventor: Ertugrul Berkcan, Schenectady, N.Y.

[73] Assignee: General Electric Company, Schenectady, N.Y.

[21] Appl. No.: 386,383

[22] Filed: Feb. 10, 1995

[51] Int. Cl.[6] ..... D06F 33/02

[52] U.S. Cl. ..... 8/158; 68/12.01; 68/12.03

[58] Field of Search ..... 68/12.01, 12.02, 68/12.03, 12.04; 8/158, 159

[56] References Cited

U.S. PATENT DOCUMENTS

| | | | |
|---|---|---|---|
| 4,037,966 | 7/1977 | Hill . | |
| 5,048,139 | 9/1991 | Matsumi et al. . | |
| 5,083,447 | 1/1992 | Kiuchi et al. . | |
| 5,105,635 | 4/1992 | Kiuchi et al. . | |
| 5,133,200 | 7/1992 | Tanaka et al. | 68/12.03 |
| 5,136,861 | 8/1992 | Kiuchi et al. . | |
| 5,140,168 | 8/1992 | King . | |
| 5,172,572 | 12/1992 | Ono . | |
| 5,255,044 | 10/1993 | Miller | 68/12.03 |
| 5,265,446 | 11/1993 | Kuroda et al. . | |
| 5,291,626 | 3/1994 | Molnar et al. . | |
| 5,297,307 | 3/1994 | Baek . | |
| 5,331,177 | 7/1994 | Kubisiak et al. . | |

FOREIGN PATENT DOCUMENTS

| | | | |
|---|---|---|---|
| 61-196995 | 9/1986 | Japan | 68/12.03 |

OTHER PUBLICATIONS

"A New control Device for Washing Machines Using a Microcomputer and Detectors" by K. Matsuo and K. Taniguchi, IEEE Transactions on Industry Applications, vol. IA-20, No. 5, Sep./Oct. 1984, pp. 1171–1178.

*Primary Examiner*—Frankie L. Stinson
*Attorney, Agent, or Firm*—Enrique J. Mora; Marvin Snyder

[57] ABSTRACT

A temperature compensation method for a turbidity sensor in an appliance for washing articles is provided. The method includes the steps of: measuring temperature and turbidity of a liquid, such as water, for washing the articles, calculating a turbidity value corresponding to a predetermined reference temperature; and adjusting the measured turbidity of the liquid with respect to the calculated turbidity value so as to provide a temperature compensated turbidity measurement. The method can further include the step of measuring temperature and turbidity of substantially particle-free liquid. This allows for calculating a normalized turbidity value which is substantially free or independent from temperature variation effects.

5 Claims, 5 Drawing Sheets

TEMPERATURE COMPENSATION METHOD FOR A TURBIDITY SENSOR USED IN AN APPLIANCE FOR WASHING ARTICLES

RELATED APPLICATIONS

This application is related to U.S. patent application Ser. No. (08/386,382) (RD-24,168) by E. Berkan, entitled "Dynamic Temperature Compensation Method for a Turbidity Sensor Used in an Appliance For Washing Articles", filed concurrently herewith, assigned to the assignee of the present invention and herein incorporated by reference.

BACKGROUND OF THE INVENTION

The present invention relates to temperature compensation and, more particularly, to a temperature compensation method for a turbidity sensor used in an appliance for washing articles.

Reducing the amount of energy consumption in appliances or machines for washing articles, such as dishwashers or clothes washers, is a significant problem, in part because a large amount of energy is needed to heat the liquid, such as water, for washing such articles. Thus, decreased liquid consumption for such machines may result in significant improvements in energy efficiency. Several techniques are available to indirectly monitor cleanliness of the articles, including a device for measuring or sensing the turbidity of the liquid used to wash the articles.

Turbidity sensors that employ an electromagnetic radiation source, such as a light emitting diode (LED) for emitting electromagnetic radiation which propagates within the cleansing liquid, typically suffer from temperature variation effects, such as power output variation as a function of temperature. The temperature variations effects, if left uncorrected, can substantially degrade the accuracy of the turbidity sensor. For example, an LED having a temperature coefficient of about 4,000 parts per million (ppm) per ° C. can result in unacceptable accuracy over the temperature range of operation of the turbidity sensor. Thus, it is desirable to provide a temperature compensation method which substantially reduces turbidity sensor errors due to temperature variation effects in the LED. It is further desirable to provide a temperature-independent intensity referencing scheme for obtaining normalized turbidity measurements which are free from temperature variation effects. This is desirable since known intensity referencing or normalization schemes, such as disclosed in U.S. Pat. No. 5,083,447 by M. Kiuchi, et al, typically rely on turbidity measurements taken at temperatures which can be very different from the actual temperature encountered during any cycle of operation of the washing machine and therefore the accuracy of such intensity referencing schemes is inherently limited by the temperature response of the sensor.

SUMMARY OF THE INVENTION

Generally speaking, the present invention fulfills the foregoing needs by providing a temperature compensation method for a turbidity sensor in an appliance for washing articles. The method comprises the steps of: measuring temperature and turbidity of a liquid, such as water, for washing the articles, calculating a turbidity value corresponding to a predetermined reference temperature; and adjusting the measured turbidity of the liquid with respect to the calculated turbidity value so as to provide a temperature compensated turbidity measurement. The method can further include the step of measuring temperature and turbidity of substantially particle-free liquid. This allows for calculating an intensity-referenced value, such as a normalized turbidity value which is substantially free or independent from temperature variation effects.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like numbers represent like parts throughout the drawings, and in which:

DETAILED DESCRIPTION OF THE INVENTION

Figure 1:
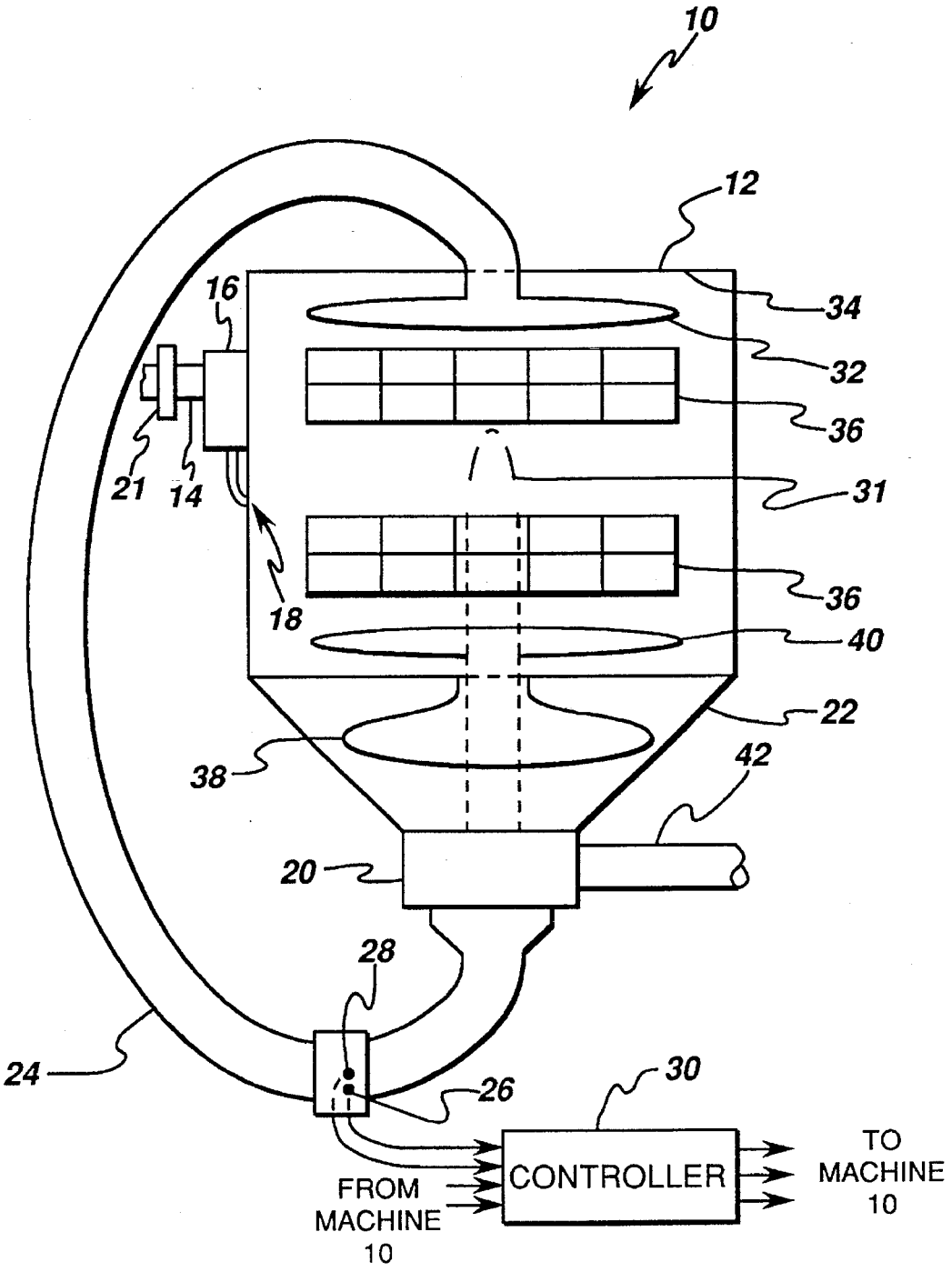
FIG. 1 is a schematic diagram of a dishwasher using a method embodying the present invention.

FIG. 1 is a schematic of an appliance 10 for cleaning or washing articles and using a method in accordance with the present invention. Although the appliance is described as a dishwasher, it will be appreciated that a clothes washer can also benefit from the teachings of the present invention. The appliance 10 includes a container 12 for containing articles during a washing. Clean water is sent to the container via a valve 21, a conduit 14, a fill funnel 16, and an aperture 18. The water is distributed and recirculated by a pump 20. In particular, water from a sump 22 is distributed from pump 20 via a recirculation hose 24. A turbidity sensor 26 and a temperature sensor 28 mounted within recirculation hose 24 measure the turbidity in the recirculation hose and the temperature of the water in the recirculation hose, respectively. Although turbidity sensor 26 is shown in FIG. 1 as being attached to recirculation hose 24, this sensor should not be limited to this location and can also be located at other locations such as the container or the pump.

Figure 2:
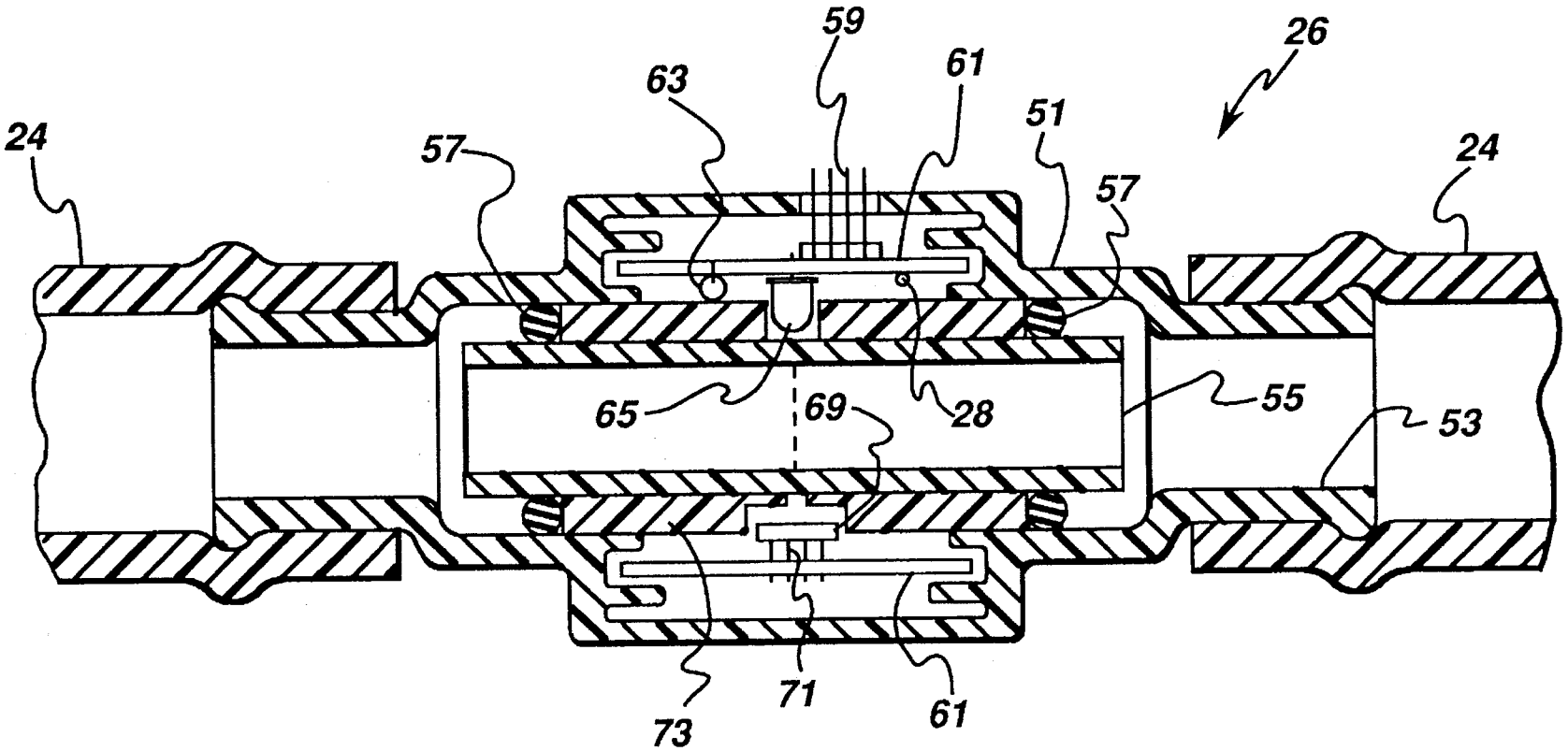
FIG. 2 is a cross-sectional view of a turbidity sensor used in the dishwasher of FIG. 1.

A more detailed view of turbidity sensor 26 and temperature sensor 28 is shown in the cross-sectional view of FIG. 2. The turbidity sensor includes a housing 51. At one end of housing 51 is a fluid flow channel 53 which is coupled to recirculation hose 24 and permits liquid to flow therethrough. Liquid flows through fluid flow channel 53 into a quartz tube 55 located inside housing 51 and coupled thereto by O-rings 57. Located above the top of quartz tube 55 is a printed circuit board 61 having a light emitting diode (LED) 65, a resistor 63, temperature sensor 28 which happens to be a thermistor, and a plurality of connectors 59 extending therefrom. It will be appreciated that other schemes can be conveniently employed for obtaining temperature measurements. For example, in an alternative embodiment, temperature sensor 28 can be conveniently deleted being that LED 65 can be effectively employed both as the source of electromagnetic radiation and as the temperature sensor being that the temperature response of an LED can be accurately characterized by a linear equation over the temperature range of interest. This can be done by measuring or monitoring the output current and/or output voltage of the LED as a function of temperature. At the bottom of quartz tube 55 is another printed circuit board 61 having various electrical components. In particular, bottom printed circuit board 61 comprises a light-to-frequency converter 69, and a plurality of connectors 71. The electronics on printed circuit board 61 are positioned within housing 51 relative to quartz tube 55 by a cylindrical spacer 73. As the liquid flows through fluid flow channel 53 into quartz tube 55, electromagnetic radiation emitted by LED 65 is transmitted or passes through the liquid along an optical axis, which is represented by the dotted line in FIG. 2. The intensity of the light transmitted through the liquid decays exponentially relative to the amount of soil therein. If there is a high soil level, then there will be a relatively small amount of radiation passing through the liquid, while a lower soil level will allow relatively more radiation passing through. The intensity of radiation received at light-to-frequency converter 69 is converted into a frequency representation by light-to-frequency converter 69 and sent to a controller 30. A more detailed explanation of the turbidity sensor is provided in commonly assigned, U.S. patent application Ser. No. (08/370,795), filed Jan. 10, 1995, entitled "Dishwasher With Turbidity Sensing Mechanism", which is incorporated herein by reference. In addition to receiving the turbidity measurements from turbidity sensor 26, controller 30 receives the temperature measurements from temperature sensor 28. Additional details about the operation of controller 30 are provided in commonly assigned, U.S. patent application Ser. No. (08/370,752), filed Jan. 10, 1995, entitled "A System And Method For Adjusting The Operating Cycle Of A Cleaning Appliance", which is incorporated herein by reference.

Figure 3:
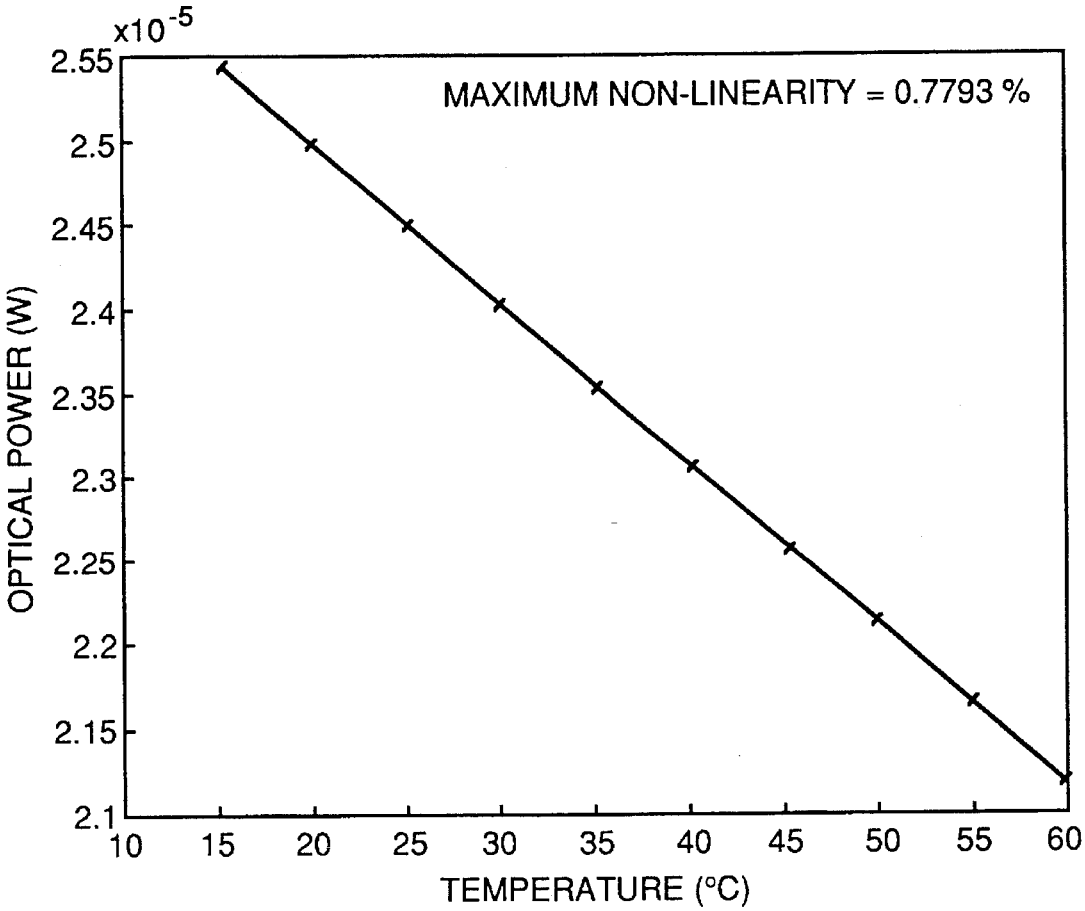
FIG. 3 is a graph showing the effects that temperature has on the optical power output of a light emitting diode located within the turbidity sensor.

FIG. 3 is a graph showing the relationship between the optical power output of LED 65 and the temperature of the liquid. The graph shows that as the temperature increases, the optical power or brightness of LED 65 decreases. Conversely, as the temperature decreases, the optical power or brightness of LED 65 increases.

Figure 4:
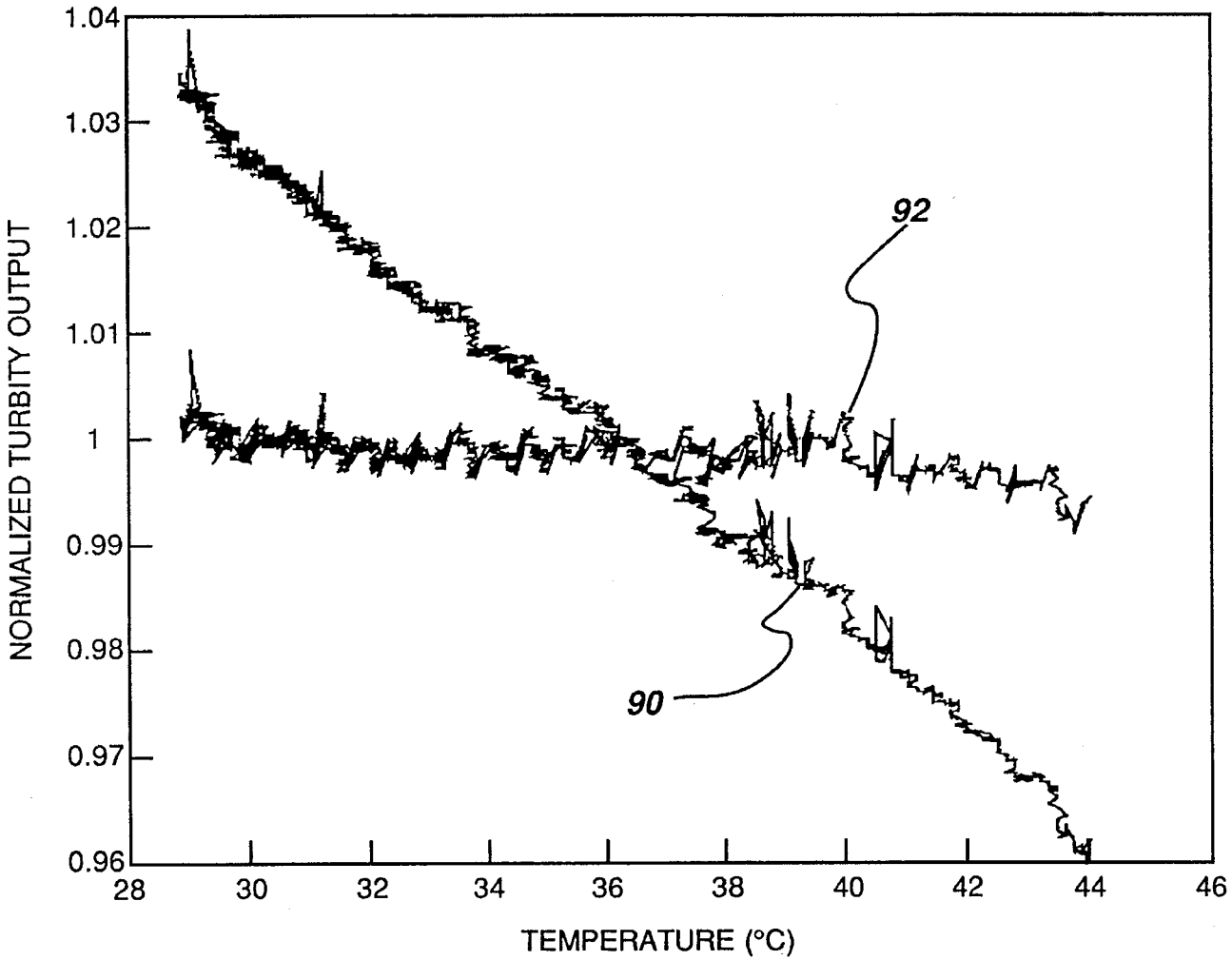
FIG. 4 is a performance curve showing the effects that temperature has on the measured turbidity values.

FIG. 4 is a performance curve that illustrates the effect that temperature has on the turbidity measurements from turbidity sensor 26. In particular, FIG. 4 shows in data plot 90 that as temperature increases, the values for turbidity measurements supplied by the turbidity sensor actually decrease. As suggested above, the values for turbidity measurements actually decrease in the performance curve because the optical power or brightness of the LED 65 is decreasing as the temperature increases (see FIG. 3). If the optical brightness is decreasing, then the measured turbidity values will decrease, and not accurately reflect the true or actual turbidity of the liquid. Thus, the turbidity measured by turbidity sensor 26 should be compensated as shown in data plot 92 to account for the changes occurring due to temperature variations.

Figure 5:
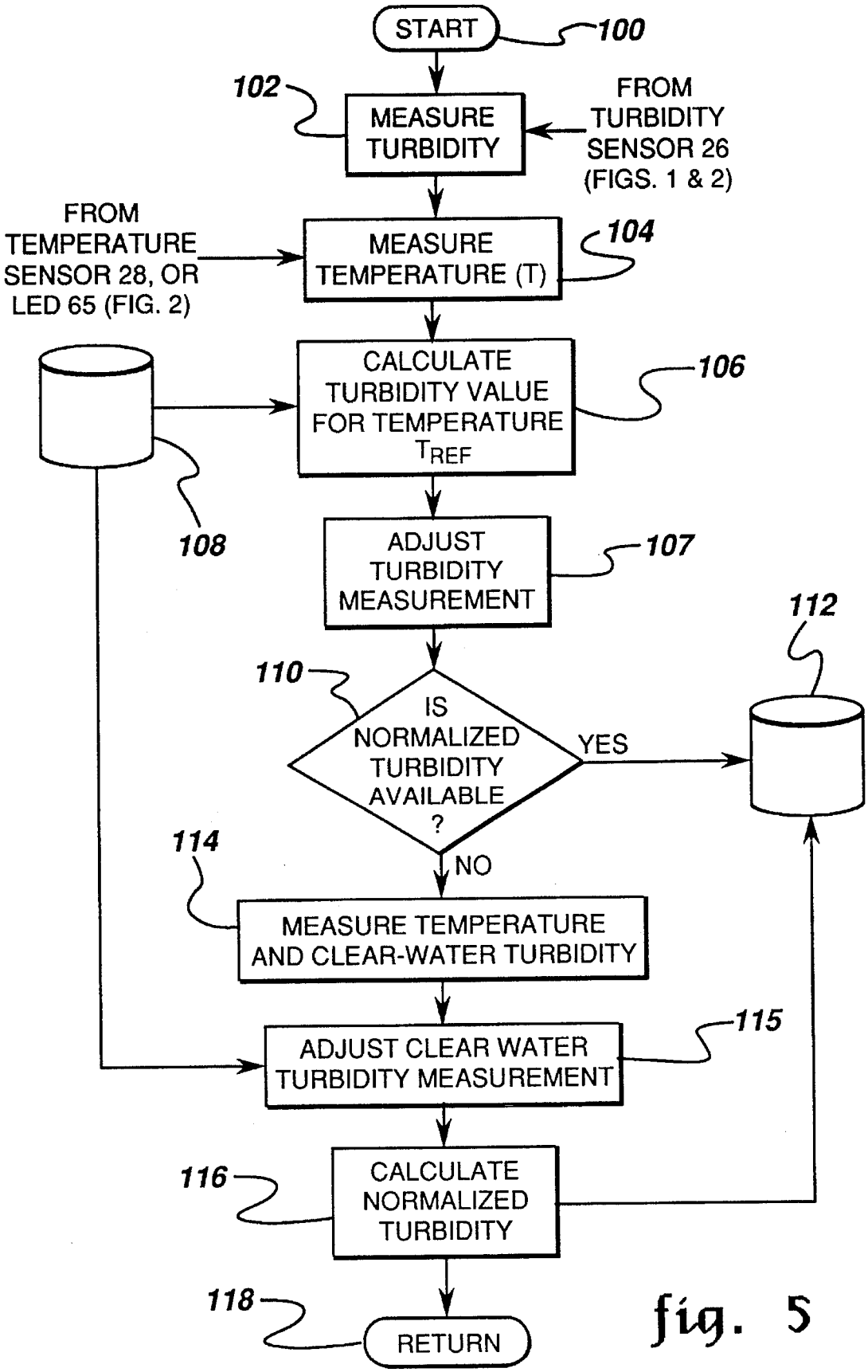
FIG. 5 is a flowchart illustrating a sequence of steps for a temperature compensation method in accordance with the present invention.

FIG. 5 is a flowchart that illustrates a sequence of steps in accordance with the present invention. After start of operations in step 100, steps 104 and 102, respectively, allow for measuring temperature and turbidity of the liquid used for washing the articles to be cleansed. Step 106 allows for calculating a turbidity value corresponding to a predetermined reference temperature, $T_{ref}$. It will be appreciated that temperature compensation can be achieved by determining offset or adjustment values that are to be added to or subtracted from the turbidity measurements from turbidity sensor 26 (FIGS. 1 and 2), depending on the temperature measured by temperature sensor 28 (FIGS. 1 and 2), or, as previously suggested, by LED 65. In each case, the offset or adjustment values are attained by choosing the temperature reference value to be within the operating temperature range of appliance 10. In the illustrative embodiment, the operating range of appliance 10 is between 24° C. and 74° C. and the temperature reference value is conveniently chosen to be 49° C. Since 49° C. is the temperature reference value, it would be preferred if the turbidity measurements were compensated to reflect the turbidity values calculated at the reference temperature. It will be appreciated that the present invention need not be limited to such specific reference temperature value being that other values for the temperature reference can work equally effective. The adjustment of the turbidity measurements to the temperature reference value (i.e., 49° C.) is attained by using linear equations, as indicated by the temperature behavior of the optical power output shown in FIG. 3. By using linear equations, offset or adjustment values for each possible temperature value in the operating temperature range can be calculated and used to compensate the turbidity measurements. It will be appreciated that the present invention is not limited to linear equations being that even turbidity sensors having a substantially nonlinear temperature response could be readily compensated to avoid temperature deviation effects. In the illustrative embodiment, if the measured temperature is greater than 49° C., then turbidity measurements are below the compensated level, and thus, the corresponding turbidity measurements need to be increased by an offset value to increase their respective level. If the measured temperature is less than 49° C., then the turbidity measurements are above the compensated level, and thus, the corresponding turbidity measurements need to be decreased by an offset value to decrease their respective level. However, if the measured temperature is equal to 49° C., then the corresponding turbidity measurements do not need to be offset or adjusted. In the illustrative embodiment, the offset values are stored in a look-up table stored in a memory 108, such as a read only memory (ROM) or an electrically erasable programmable read only memory (EEPROM) in controller 30 (FIG. 1). Thus, as controller 30 receives a turbidity measurement from turbidity sensor 26 and a temperature measurement from temperature sensor 28, the controller will refer the measured temperature to the look-up table of offset values. The controller will then read the offset value corresponding to the measured temperature and, as shown in step 107, adjust the turbidity measurement accordingly. It will be appreciated that the temperature compensation need not be implemented using a look-up table since temperature compensation can also be achieved by deriving or calculating a temperature coefficient based upon the turbidity and temperature measurements. For example, the temperature coefficient can be calculated using a least-squares fit to a straight line or other well known mathematical techniques, such as described in textbook entitled "Data Reduction And Error Analysis For The Physical Sciences", by P. R. Bevington, available from Mcgraw-Hill Book Company. It will be appreciated that the temperature coefficient conveniently allows for characterizing or determining the temperature response of the turbidity sensor over a desired temperature range. Step 110 allows for determining whether intensity-referenced turbidity values, such as normalized turbidity values, are available, that is, whether normalized turbidity values have been previously generated using, for example, an intensity referencing scheme, and are available to controller 30. For a detailed discussion of various intensity referencing schemes, see Chapter 12 in the book entitled "Optical Fiber Sensors: Systems and Applications", Volume 2, edited by B. Culshaw and J. Dakin, available from Artech House, Inc. The normalized turbidity values are desirable being that such normalized turbidity values allow for performing self-calibration of the turbidity sensor and for controlling the intensity of the electromagnetic radiation source. For example, the self-calibration of the turbidity sensor can be performed by measuring the electromagnetic radiation transmitted or scattered when substantially particle-free liquid, such as substantially clear or clean water, is disposed between LED 65 (FIG. 2) and light-to-frequency converter 69 (FIG. 2). As will be appreciated by those skilled in the art, any signals or measurements produced by the turbidity sensor during any given cycle of operation of the appliance can then be conveniently intensity-referenced or normalized by taking a ratio of such signals or measurements with the appropriate transmission and scatter values of electromagnetic radiation propagated through the substantially particle-free liquid. If the normalized turbidity values are available in step 110, then such normalized values can be conveniently stored in a memory 112, such as a ROM or an EEPROM located in controller 30. In this manner, any signal measurements provided by the turbidity sensor can be conveniently updated or calibrated in controller 30 (FIG. 1). If the normalized turbidity values are not available in step 110, then step 114 allows for measuring temperature and turbidity of substantially particle-free liquid. Step 115 allows for adjusting the measured substantially particle-free liquid turbidity from step 114 relative to the calculated turbidity value corresponding to the temperature reference value, that is, step 115 allows for removing any temperature variation effect from the turbidity measurement obtained in step 114. Prior to end of operations in step 118, step 116 allows for calculating a normalized turbidity value which is substantially free of temperature variation effects and which, as suggested above, is stored in memory 112 in controller 30 (FIG. 1). For example, the normalized turbidity measurement can be readily calculated by taking the ratio of any turbidity measurement adjusted for temperature variation effects obtained in step 102 and the adjusted turbidity measurement for substantially particle-free liquid obtained in step 115.

While only certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. A temperature compensation method for a turbidity sensor used in an appliance for washing articles, said method comprising:

measuring temperature and turbidity of a liquid for washing said articles;

calculating a turbidity value corresponding to a predetermined reference temperature; and adjusting the measured turbidity of the liquid with respect to the calculated turbidity value to provide a temperature compensated turbidity measurement.

2. The temperature compensation method of claim 1 further comprising the step of measuring temperature and turbidity of substantially particle-free liquid.

3. The temperature compensation method of claim 2 further comprising the step of adjusting the measured turbidity of substantially particle-free liquid relative to the calculated turbidity value.

4. The temperature compensation method of claim 3 further comprising the step of calculating a normalized turbidity value which is substantially free of temperature variation effects.

5. The temperature compensation method of claim 4 wherein the step of calculating the normalized turbidity value comprises a ratio of the temperature compensated turbidity measurement and the adjusted measured turbidity of substantially particle-free liquid.

* * * * *